US006386374B1

(12) United States Patent
Miller et al.

(10) Patent No.: US 6,386,374 B1
(45) Date of Patent: May 14, 2002

(54) MULTI-MASS FILTER WITH ELECTRIC FIELD VARIATIONS

(75) Inventors: Robert L. Miller, San Diego; Tihiro Ohkawa, La Jolla; Richard L. Freeman, Del Mar, all of CA (US)

(73) Assignee: Archimedes Technology Group, Inc., San Diego, CA (US)

( * ) Notice: Subject to any disclaimer, the term of this patent is extended or adjusted under 35 U.S.C. 154(b) by 0 days.

(21) Appl. No.: 09/860,161

(22) Filed: May 17, 2001

Related U.S. Application Data

(62) Division of application No. 09/643,204, filed on Aug. 21, 2000, now Pat. No. 6,293,406.

(51) Int. Cl.[7] ..... B03C 1/30

(52) U.S. Cl. ..... 209/39; 209/223.2; 209/224; 209/234; 210/695; 210/748; 210/222

(58) Field of Search ..... 209/213, 39, 214, 209/223.2, 224, 226, 227, 231, 232; 210/695, 748, 222, 223, 243

(56) References Cited

U.S. PATENT DOCUMENTS

| | | | | | |
|---|---|---|---|---|---|
| 3,845,300 | A | * | 10/1974 | Roeling et al. | 250/282 |
| 3,942,975 | A | * | 3/1976 | Drummond et al. | 75/10 |
| 4,093,856 | A | * | 6/1978 | Stenzel | 250/293 |
| 4,167,668 | A | * | 9/1979 | Mourier | 250/291 |
| 4,213,043 | A | * | 7/1980 | Dawson | 250/283 |

* cited by examiner

*Primary Examiner*—Donald P. Walsh
*Assistant Examiner*—Jonathan R. Miller
(74) *Attorney, Agent, or Firm*—Nydegger & Associates

(57) ABSTRACT

A multi-mass filter for separating particles of a multi-species plasma includes a chamber, which defines an axis. A radial electric field is crossed with a magnetic field (E×B) to move the particles of different mass ($M_1$, $M_2$ and $M_3$) on respective trajectories into respective first, second and third regions. Specifically, particles $M_1$ are confined in the first region, while both particles $M_3$ and $M_2$ are ejected from the first region into the second region and only the particles $M_3$ are ejected from the second region into the third region.

17 Claims, 1 Drawing Sheet

MULTI-MASS FILTER WITH ELECTRIC FIELD VARIATIONS

This application is a divisional application Ser. No. 09/643,204, filed Aug. 21, 2000 is now U.S. Pat. No. 6,293,406, which is currently pending. The contents of application Ser. No. 09/643,204 are incorporated herein by reference.

FIELD OF THE INVENTION

The present invention pertains generally to devices and methods that are useful for separating particles of a multi-species plasma according to their mass-charge ratios. More particularly, the present invention pertains to plasma mass filters which operate at plasma densities that are below the collisional density of the multi-species plasma being processed. The present invention is particularly, but not exclusively, useful as a filter for separating and segregating charged particles from a multi-species plasma into more than two different parts.

BACKGROUND OF THE INVENTION

There are many reasons why it may be desirable to separate a composite material into its constituent elements. Just as there are many such reasons, there are many ways or methods by which this can be accomplished. For one, it is well known that some composite or combination materials can be mechanically separated by means such as sieves, sorters and; diverters. Further, it is known that chemical processes are often useful for separating composites into their separate parts. It happens, however, that some composite materials are extremely difficult to process and, therefore, do not readily lend themselves to the more conventional methods of processing. In particular, nuclear waste is such a composite material.

Recently, efforts have been made to process materials by first vaporizing them, and then causing the vaporized constituent elements to separate from each other. One such process involves the use of a plasma centrifuge. In a plasma centrifuge, the charged particles of a plasma are caused to rotate around a common axis, and to collide with each other as they rotate. As a consequence of these collisions, the heavier mass particles move farther away from the axis of rotation than do the lighter mass particles. Accordingly, the particles are separated according to their respective masses. More recently, however, plasma filters have been developed which rely on physical principles that are much different than those relied on by plasma centrifuges.

An example of a plasma filter and its methods of operation are provided in U.S. Pat. No. 6,096,220, issued to Ohkawa, for an invention entitled "Plasma Mass Filter" which is assigned to the same assignee as the present invention. Several aspects of a plasma filter that distinguish it from a plasma centrifuge are noteworthy. In particular, unlike a plasma centrifuge, it is important that a plasma filter operates with a plasma density that is below a collisional density. By definition, and as used herein, a collisional density occurs when the ratio of a cyclotron angular frequency to a collisional frequency is greater than one (i.e. $\omega_c/v>1$). Stated differently, in a plasma having a density below its collisional density, there is a high probability that a charged particle will experience at least one orbited rotation before colliding with another charged particle in the plasma. Thus, very much unlike a plasma centrifuge, a plasma filter avoids collisions between the charged particles. Another aspect which distinguishes a plasma filter from a plasma centrifuge is that crossed electric and magnetic fields can be employed in a plasma filter to selectively confine the trajectories of orbiting charged. particles. Specifically, as disclosed for the plasma mass filter by Ohkawa mentioned above, charged particles having a mass-charge ratio below a determinable cut-off mass, $M_c$, will be confined within a space between the axis of rotation and a radial distance, "a," therefrom. As previously disclosed by Ohkawa, for a cylindrical plasma mass filter chamber, $M_c=ea^2B^2/(8V_{ctr})$ wherein there is a radius, "a," a uniform axial magnetic field, "B," and a parabolic radial voltage profile with a central voltage, "$V_{ctr}$," with the wall of the cylinder grounded. The charge on the heavy ion to be separated is "e."

It can happen that it may be desirable, or necessary, to separate a composite material into more than two parts. For example, it may be desirable to separate a nuclear waste into three or more component parts. For example, one part may be a radioactive toxic nuclear component which must be disposed of under most careful circumstances. On the other hand, another part of the composite material may be useful in other different processes. Still another part may be disposable by more ordinary and conventional means.

In light of the above, it is an object of the present invention to provide a multi-mass filter that is capable of separating a multi-species plasma into more than two constituent parts. Another object of the present invention is to provide a multi-mass filter which effectively confines charged particles of different mass-charge ratios to trajectories that direct the charged particles into respectively different regions for segregated collection. Still another object of the present invention is to provide a multi-mass filter that is relatively simple to manufacture, is easy to use, and is comparatively cost effective.

SUMMARY OF THE PREFERRED EMBODIMENTS

A multi-mass filter for separating particles in accordance with the present invention includes a chamber that defines an axis and has specifically configured crossed electric and magnetic fields (E×B) inside the chamber. For the present invention, the linearly increasing electric field (E) is generated with a positive voltage $V_{ctr}$ along the chamber axis and is oriented to extend radially therefrom toward a ground at the chamber wall. The magnetic field (B), on the other hand, is generated to extend through the chamber generally parallel to the axis.

With the above in mind, let the term "$a_z$," represent a radial distance from the axis at an arbitrary "z" location on the axis. Similarly, let the term "$B_z$" represent a magnetic field strength at the same arbitrary "z" location on the axis. With "e" representing a positive ion charge, an expression for cut-off mass becomes $M_{cz}=ea_z^2B_z^2/(8V_{ctr})$ assuming a quadratic dependence of voltage with a radius between 0 and $a_2$ and the voltage at the wall is zero since the wall is grounded. As can be shown mathematically for the $M_{cz}$, expression, particles that have mass-charge ratios below $M_{cz}$, are confined by the crossed electric and magnetic fields inside the chamber between the axis and a radial distance $a_z$, from the axis. On the other hand, particles that have mass-charge ratios above $M_{cz}$, will be ejected beyond the radial distance $a_z$ from the axis. As intended for the present invention, a multi-species plasma is introduced into the chamber to interact with the crossed electric and magnetic fields under conditions which allow the particles to orbit around the chamber axis. Specifically, for purposes of the present invention it is contemplated that the multi-species plasma will include particles of relatively low mass-charge ratio ($M_1$), particles of intermediate mass-charge ratio ($M_2$), and particles of relatively high mass-charge ratio ($M_3$). Further, it is contemplated that the multi-species plasma will have a density inside the chamber that is less than a predetermined collisional density. For the present invention, collisional density is defined by considering that all of the particles $M_1$, $M_2$ and $M_3$ will have a collision frequency $\nu_{col}$, inside the chamber. The particles will also have their respective cyclotron frequencies $\omega_{m1}$, $\omega_{m2}$ and $\omega_{m3}$ in response to the crossed electric and magnetic fields (E×B). Thus, as defined herein, a collisional density occurs whenever $\omega_{m1}>\omega_{m2}>\omega_{m3}>V_{col}$. Stated differently, the predetermined collisional density is defined when a ratio between $\omega_{m3}$ and the collision frequency is greater than one (i.e. $\omega_{m3}/\nu_{col}>1$) and, preferably, much greater than one.

It is a consequence of the present invention that the crossed electric and magnetic fields (E×B) are created to establish respective first trajectories for each of the particles ($M_1$), second trajectories for each of the particles ($M_2$), and third trajectories for each of the particles ($M_3$). Further, the crossed electric and magnetic fields (E×B) will also respectively direct each of the particles $M_1$, $M_2$ and $M_3$ along their respective trajectories into respective first, second and third regions to thereby separate the particles ($M_1$, $M_2$ and $M_3$) according to mass-charge ratio.

For one embodiment of the present invention, the magnetic field (B) will vary along the axis. For this embodiment, both the chamber and the magnetic field, B, are configured to maintain the conservation of magnetic flux through the chamber along the axis of the chamber. Specifically, in this embodiment, the chamber wall is distanced farther from the axis in a direction along the axis that will be taken by the multi-species plasma as it transits through the chamber. For there to be a conservation of magnetic flux, however, the term "$a_z^2B_z$" must remain substantially constant in the expression for $M_{cz}$. Thus, due to the changes in the cross section of the chamber for this embodiment (i.e. change in "$a_z$"), the magnetic field $B_z$, must also be varied. For the present invention, this can be accomplished using magnetic coils that are positioned in planes substantially perpendicular to the axis to surround the chamber. These coils can then be controlled to establish the requisite magnetic field strengths along the axis. In accordance with the present invention, in order for $a_z^2B_z$ to remain constant, as "$a_z$," increases, $B_z$ will decrease. Thus, for this embodiment, particles $M_3$ that are greater than $M_{c3}$will be ejected into the third region, particles $M_2$ that are greater than $M_{c2}$ will be ejected into the second region (where $a_2>a_3$ and $B_2<B_3$) and, finally, the particles $M_1$ will be ejected into the first region (where $a_1>a_2$ and $B_1<B_2$).

For another embodiment of the present invention, the magnetic field (B) in the chamber is maintained so as to be substantially constant along the axis. The electric field (E), however, is established with a particular configuration. Specifically, the electrical field increases linearly at a first rate in a radial direction outwardly from the axis. This first rate of increase occurs through a radial distance $a_2$ and defines the first region. It also establishes a cut-off mass $M_{c2}=er_2^2B^2/(8*(V_{ct}-V_2))$ where $V_2$ is the voltage at $a_2$ ($r_2$) so that $M_3$ and $M_2$, which are both greater than $M_{c2}$, will be ejected from the first region. At the radial distance $a_2$ ($r_2$) from the axis, however, the electrical field is caused to decrease, and then linearly increase radially outward at a second, slower rate. Between $a_2$ ($r_2$) and a radial distance $a_3$ ($r_3$), this second, slower rate of increase in the electrical field establishes a cut-off mass $M_{c3}=e(r_3^2-r_2^2)B_2/(8*V_2)$ where $V_3$ is the voltage at $a_3$ ($r_3$) and is generally zero. Because $M_3$ is greater than $M_{c3}$ and $M_2$ is less than $M_{c3}$, particles $M_3$, but not particles $M_2$, will be ejected from the second region into the third region. For this embodiment, the third region is preferably the wall of the chamber. The first and second regions, however, extend axially from the chamber. As contemplated by the present invention, the particular configuration for the electric field (E) in this embodiment can be established using either concentric electrode rings, or spiral electrodes, which are positioned in planes that are oriented substantially perpendicular to the axis.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENT

Figure 1:
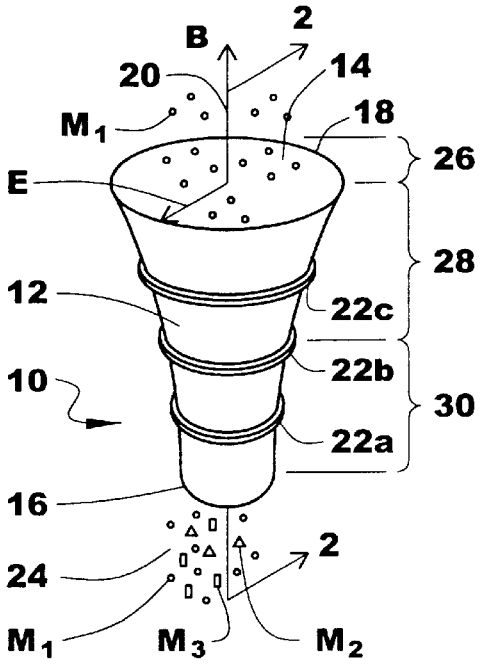
FIG. 1 is a perspective view of one embodiment for a plasma filter chamber in accordance with the present invention.

Referring initially to FIG. 1, one embodiment for a plasma multi-mass filter in accordance with the present invention is shown and is generally designated 10. As shown, the filter 10 includes a chamber 12 that is surrounded by a wall 14. The chamber 12 has an end 16 and an end 18 and generally defines a longitudinal axis 20 that extends centrally along the length of the chamber 12. The filter 10 also includes a plurality of magnetic coils 22, of which the coils **22*a*, 22*b* and 22*c* are exemplary. As shown, the coils are oriented in respective parallel planes that are perpendicular to the axis 20. With this configuration, a magnetic field (B) is established in the chamber 12 that extends generally in the direction of the axis 20. An electrical unit, that may include ring electrodes or a spiral electrode (not shown in FIG. 1), will establish an electrical field (E) in the chamber 12 that is radially oriented and will, therefore, establish crossed electric and magnetic fields (E×B) in the chamber 12**.

As intended for the present invention, the filter 10 is used to process a multi-species plasma 24 that will include at least three species. These species are to be distinguished by their respective mass-charge ratios. As shown in the drawings, charged particles of relatively low mass-charge ratio are designated $M_1$. Charged particles of intermediate mass-charge ratio are designated $M_2$, and charged particles of relatively high-mass charge ratio are designated $M_3$. The subtleties of how the crossed electric and magnetic fields (E×B) cause the particles $M_1$, $M_2$ and $M_3$ to move in the chamber 12 will be best appreciated by cross referencing FIG. 1 with FIG. 2.

Figure 2:
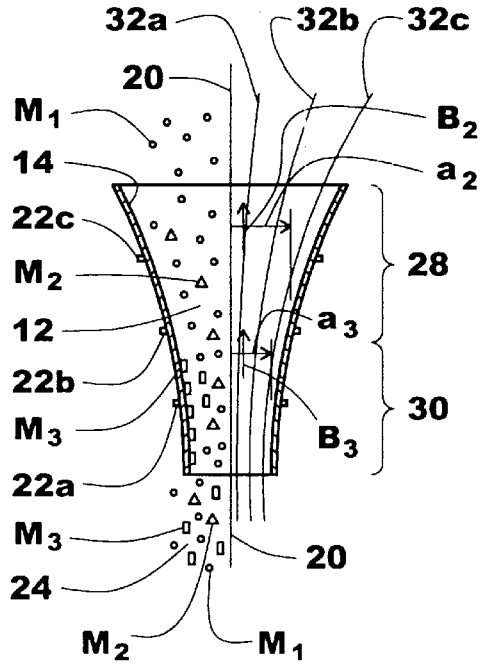
FIG. 2 is a cross sectional view of the embodiment of the plasma filter chamber as seen along the line 2—2 in FIG. 1.

Both FIG. 1 and FIG. 2 show that for one embodiment of the present invention the radial distance from the axis 20 to the wall 14 (designated "a" in the drawings) will vary along the length of the filter 10. Thus, the configuration of the chamber 12 is such that the radial distance "a" at end 18 is larger than the radial distance "a" at end 16. For purposes of further discussion, consider using the character "z" to designate positions along the axis 20. With this designation scheme, at a position where z is to be designated 2, the radial distance at that position will be $a_z=a_2(r_2)$ and the field strength will be $B_z=B_2$. Where z is to be designated 3, $a_z=a_3(r_3)$ and $B_z=B_3$. As shown in FIG. 2, the configuration of the chamber 12 is such that $a_2(r_2)$ is larger than $a_3(r_3)$. On the other hand, the magnetic field strength decreases as the corresponding radial distance increases. Accordingly, the magnetic field strength $B_3$, at the position z designated 3, is larger than the magnetic field strength $B_2$, at the position z designated 2. Importantly, this relationship is maintained along the axis 20 of the filter 10 so that the magnetic flux ($a_z^2B_z$) will remain substantially constant in the chamber 12 (e.g. $a_2^2B_2=a_3^2B_3$).

By predetermining the configuration of the wall 14, and by controlling the magnitude of the magnetic field in the chamber 12, the expression for a cut-off mass discussed above can be established to effectively divide the chamber 12 into three separate regions. In detail, by establishing predetermined values for $M_{cz}$, at specific "z" positions along the axis 20, the particles $M_1$ in the multi-species plasma 24 can be confined on trajectories which will cause them to transit completely through the chamber 12, for collection in a first region 26. This can be done so that the particles $M_1$ do not collide with the wall 14. As shown in FIG. 1 and FIG. 2, the first region 26 for one embodiment of the filter 10 is located beyond the end 18 of the filter 10.

As implied above, confinement of the particles $M_1$ inside the chamber 12 is accomplished by establishing specific conditions within the chamber 12 (e.g. $M_{c2}=er_2^2B^2/(8*(V_{ctr}-V_2))$, and $M_{c3}=e(r_3^2-r_2^2)B^2/(8*V_2)$. Because $M_1<M_{c2}<M_{c3}$, the conditions for $M_{c2}$ and $M_{c3}$ will establish trajectories for the particles $M_1$ that prevent the particles $M_1$ from reaching the wall 14 of the chamber 12. On the other hand, because $M_{c2}<M_2<M_{c3}$, the particles $M_2$ in the multi-species plasma 24 will follow trajectories that take them into a second region 28, but prevent them from entering a first region 26. Further, because $M_{c2}<M_{c3}<M_3$, the particles $M_3$ will follow trajectories that take them into the third region 30 before they can enter the second region 28. Recall, for the conditions just discussed, there is a substantially constant magnetic flux in the chamber 12. Therefore, the magnetic field will have magnetic field lines 32 which diverge for travel along the axis 20 from end 16 to end 18. The magnetic field lines 32*a–c* shown in FIG. 2 are only exemplary.

Figure 3:
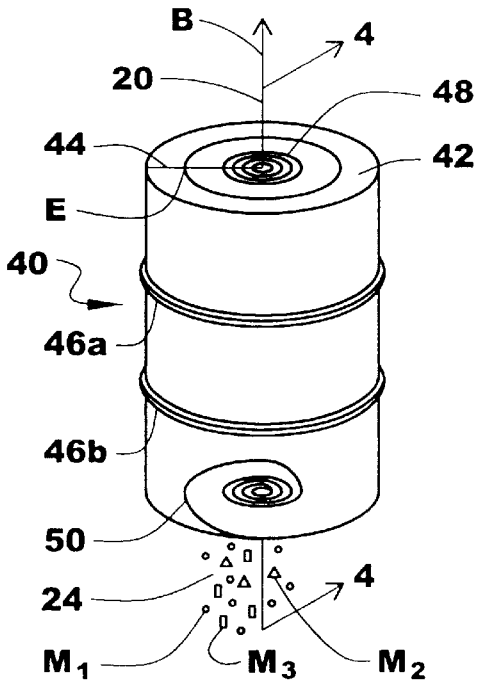
FIG. 3 is a perspective view of an alternate embodiment for a plasma filter chamber in accordance with the present invention.

Another embodiment for a filter in accordance with the present invention is shown in FIG. 3 and is generally designated 40. As shown, the filter 40 has a substantially cylindrical shaped chamber 42 that is centered on the longitudinal axis 20 and is defined by a wall 44. Additionally, there are a plurality of magnetic coils 46 (the magnetic coils 46*a* and 46*b* are only exemplary) that establish a substantially uniform magnetic field B which extends through the chamber 42 in a direction that is generally parallel to the axis 20. An electric field, E, is created inside the chamber which crosses with the magnetic field, B, to establish crossed electric and magnetic fields (E×B) in the chamber 42. As intended for the present invention, the electric field, E, can be generated in a manner well known in the pertinent art using either a ring electrode unit 48 or a spiral electrode 50. The particulars of the electric field, E, are perhaps best appreciated with reference to FIG. 4.

Figure 4:
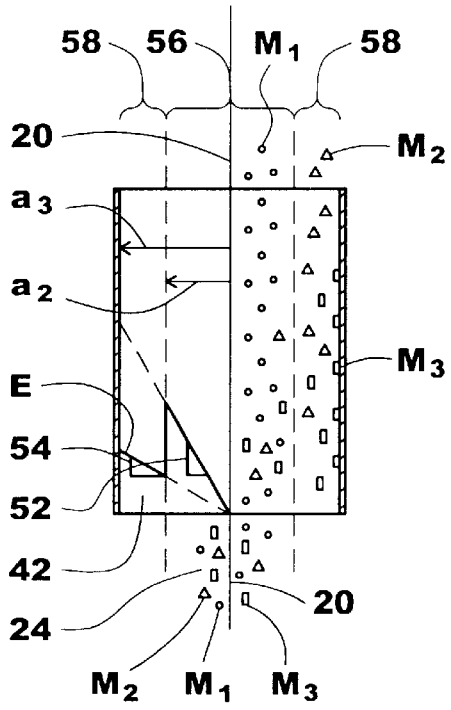
FIG. 4 is a cross sectional view of the alternate embodiment of the plasma filter chamber as seen along the line 3—3 in FIG. 3.

In FIG. 4, it will be seen that the electric field, E, is established between the wall 44, which is at ground, and a positive voltage, $V_{ctr}$, that extends along the axis 20. In accordance with the present invention, the electric field, E, has a profile in the chamber 42 that increases outwardly from the axis 20 through a radial distance "$a_2$" ($r_2$) at a rate of change 52. At the radial distance "$a_2$" ($r_2$) there is then a discontinuous decrease in the electric field E, and the electric field then continues to increase outwardly from the radial distance "$a_2$" ($r_2$) to a radial distance "$a_3$" ($r_3$) at a rate of change 54. As shown, the rate of change 52 is greater than the rate of change 54.

Again, using the expression for cut-off mass discussed above, namely $M_{cz}=ea_z^2B_z^2/(8V_{ctr})$, the chamber 42 (FIGS. 3 and 4), like the chamber 12 (FIGS. 1 and 2) can be effectively divided into three separate regions. In the case of the chamber 42, however, this results from the configuration of the electric field, E. Since the ratio of E/r is a constant but changes magnitude between the inner and outer regions, the mass cut-offs for this case must be modified: $M_{c2}=eB^2/(4*(E_2/r))=er_2^2B^2/(8*(V_{ctr}-V_2))$ where the average radius is $r=r_2/2$ and the average electric field between the axis and $r_2$ is $E_2=(V_{ctr-V2})/r_2$ and $M_{c3}=eB^2(4*(E_{3/r))=e(r_3^2-r_2^2)B^2/(8*V_2)}$ where the average radius for the outer region is $r=(r_3+r_2)/2$ and the average electric field between $r_2$ and $r_3$ is $E_3=V_2/(r_3-r_2)$ since $V_3=0$. The voltages, $V_{ctr}$ on the axis and $V_2$ at $r_2$, are externally controlled to select the respective mass cut-offs.

Referring to FIG. 4, it will be seen that by satisfying the expression $M_{c2}=er_2^2B^2/(8*(V_{ctr}-V_2))$, wherein $M_1<M_{C2}<M_{c3}$, the particles $M_1$ will be confined to travel on trajectories in the chamber 42 which do not travel radially more than a distance "$a_2$" ($r_2$) from the axis 20. Thus, the particles $M_1$ are ejected from the chamber 42 into a first region 56 that extends generally along the axis 20. On the other hand, the particles $M_2$ and $M_3$ are not so confined and will have trajectories that take them into a second region 58 that surrounds the first region 56. Specifically, the second region 58 is outside the first region 56 at more than the distance "$a_2$" ($r_2$) from the axis 20.

Due to the configuration of the electric field, E, in the chamber 42, the expression for cut-off mass $M_{c3}=e(r_3^2-r_2^2)B^2/(8*V_2)$ can be used to confine particles $M_2$ in the second region 58, but not the particles $M_3$. Instead, the particles $M_3$ are able to follow trajectories into a third region. In this case, the third region is actually the wall 44. Accordingly, as shown in FIG. 4, when the multi-species plasma 24 is introduced into the chamber 42, the particles $M_1$ will be confined in the chamber 42 for ejection therefrom into the first region 56. The particles $M_2$, on the other hand are allowed to proceed with the particles $M_3$ beyond the first region 56. Still, the particles $M_2$ will be confined within the chamber 42 and ejected therefrom into the second region 58. The particles $M_3$, however, are not confined to either the first region 56 or the second region 58 and, instead, are able to collide directly into the wall 44. The particles $M_1$, $M_2$ and $M_3$ can then be collected from their respective regions.

While the particular Multi-Mass Filter With Electric Field Variations as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A multi-mass filter for separating particles according to mass which comprises:

a chamber having a chamber wall;

a means for providing a multi-species plasma including particles of relatively low mass-charge ratio ($M_1$), particles of intermediate mass-charge ratio ($M_2$), and particles of relatively high mass-charge ratio ($M_3$), said multi-species plasma having a density in said chamber less than a predetermined collisional density;

a means for establishing an electric field crossed with a magnetic field (E×B) in said chamber to move said particles ($M_1$, $M_2$ and $M_3$) on respective trajectories in said chamber;

a first means for configuring (E×B) to confine said particles $M_1$ in a first region of said chamber; and a second means for configuring (E×B) to confine said particles $M_2$ to a second region of said chamber and to allow said particles $M_3$ to collide with said chamber wall for collection therefrom.

2. A multi-mass filter as recited in claim 1 wherein said particles $M_1$, $M_2$ and $M_3$, have a collision frequency, $\nu_{col}$, and respective cyclotron frequencies $\omega_{m1}$, $\omega_{m2}$ and $\omega_{m3}$, and wherein $\omega_{m1}>\omega_{m2}>\omega_{m3}>\nu_{col}$ with said predetermined collisional density being defined when a ratio between $\omega_{m3}$ and said collision frequency with $M_3$ is greater than one ($\omega_{m3}/\nu_{col}>1$).

3. A multi-mass filter as recited in claim 1 comprising two said chambers, wherein each said chamber has a first end and a second end and wherein said first end of one said chamber is joined with said first end of said other chamber.

4. A multi-mass filter as recited in claim 1 wherein said chamber defines an axis, wherein said magnetic field (B) is substantially constant along said axis and is oriented substantially parallel thereto, wherein said electric field (E) is generated with a positive voltage $V_{ctr}$ along said axis to extend said electric field (E) substantially radially therefrom, wherein "e" represents a positive ion charge, and wherein said first configuring means creates an electrical field increasing at a first rate extending radially outward between said axis and a radial distance $a_2$ ($r_2$) to define said first region therebetween and establish a cut-off mass $M_{c2}=er_2^2B^2/(8*(V_{ctr}-V_2))$ with $M_3$ and $M_2$ being greater than $M_{c2}$ so particles $M_3$ and $M_2$ shift from said first region into said second region, and further wherein said second configuring means creates an electrical field increasing radially outward between said radial distance $a_2$ ($r_2$) and a radial distance $a_3$ ($r_3$) at a second rate to establish a cut-off mass $M_{c3}=e(r_3^2-r_2^2)B^2/(8*V_2)$, with $M_3$ being greater than $M_{c3}$ so particles $M_3$ shift from said second region into a third region in said chamber for collision with said chamber wall.

5. A multi-mass filter as recited in claim 4 wherein said chamber defines an axis and wherein said first region extends radially from said axis through a radial distance $a_2(r_2)$, and wherein said second region extends radially from said axis through a radial distance from $a_2(r_2)$to $a_3(r_3)$, with $a_3(r_3)$ being greater than $a_2(r_2)$.

6. A multi-mass filter as recited in claim 5 further comprising:

a means for collecting said particles $M_1$ from said first region; and a means for collecting said particles $M_2$ from said second region.

7. A multi-mass filter as recited in claim 4 wherein said first configuring means and said second configuring means include concentric electrode rings, and wherein said electrode rings produce a radial electric field in a plane substantially perpendicular to said axis.

8. A multi-mass filter as recited in claim 4 wherein said first configuring means and said second configuring means are combined as a spiral electrode, and wherein said spiral electrode is oriented in a plane substantially perpendicular to said axis.

9. A multi-mass filter for separating particles according to their mass which comprises:

a chamber defining an axis and having a chamber wall;

a means for providing a multi-species plasma in said chamber, said multi-species plasma including particles of relatively low mass-charge ratio ($M_1$), particles of intermediate mass-charge ratio ($M_2$), and particles of relatively high mass-charge ratio ($M_3$), said multi-species plasma having a density in said chamber less than a predetermined collisional density;

a means for generating a magnetic field (B) in said chamber wherein said magnetic field (B) is substantially constant along said axis and is oriented substantially parallel thereto; and an electrical means for creating a radial distribution for electrical fields ($E_1/E_2$) having a positive voltage $V_{ctr}$ along said axis with said electric field ($E_1$) increasing at a first rate radially outward between said axis and a radial distance $a_2$ ($r_2$) to define a first region therebetween and establish a cut-off mass $M_{c2}=er_2^2B^2/(8*(V_{ctr}-V_2))$, wherein "e" represents a positive ion charge, with $M_3$ and $M_2$ being greater than $M_{c2}$ to shift particles $M_3$ and $M_2$ from said first region into a second region, and with said electrical field (E2) increasing radially outward between said radial distance $a_2$ ($r_2$) and a radial distance $a_3$ ($r_3$) at a second rate to establish a cut-off mass $M_{c3}=e(r_3^2-r_2^2)B^2/(8*V_2)$ with $M_3$ being greater than $M_{c3}$ to shift particles $M_3$ from said second region into a third region for collision with said chamber wall and for collection therefrom.

10. A multi-mass filter as recited in claim 9 wherein said electrical field ($E_1$) and said electrical field ($E_2$) are respectively created by concentric electrode rings and oriented substantially perpendicular to said axis to generate E×B forces on said particles $M_1$, $M_2$ and $M_3$.

11. A multi-mass filter as recited in claim 9 wherein said electrical field ($E_1$) and said electrical field ($E_2$) are created together by a spiral electrode, and wherein said spiral electrode is oriented in a plane substantially perpendicular to said axis to generate E×B forces on said particles $M_1$, $M_2$ and $M_3$.

12. A multi-mass filter as recited in claim 9 wherein said particles $M_1$, $M_2$ and $M_3$, have a collision frequency, $\nu_{col}$, and respective cyclotron frequencies $\omega_{m1}$, $\omega_{m2}$ and $\omega_{m3}$, and wherein $\omega_{m1}>\omega_{m2}>\omega_{m1}>\nu_{col}$ with said predetermined collisional density being defined when a ratio between $\omega_{m3}$ and said collision frequency with $M_3$ is greater than one ($\omega_{m3}/\nu_{col}>1$).

13. A multi-mass filter for separating particles according to mass which comprises:

a chamber;

a means for providing a multi-species plasma in said chamber, said multi-species plasma including particles of relatively low mass-charge ratio ($M_1$), particles of intermediate mass-charge ratio ($M_2$), and particles of relatively high mass-charge ratio ($M_3$), said multi-species plasma having a density in said chamber less than a predetermined collisional density; and a means for configuring a radial distribution for an electric field (E), in said chamber in combination with an axial magnetic field (B), to provide E×B forces on said particles to establish respective first trajectories for each of said particles ($M_1$), second trajectories for each of said particles ($M_2$), and third trajectories for each of said particles ($M_3$), and to respectively direct each said particle ($M_1$) on its said first trajectory from said chamber into a first region, to direct each said particle ($M_2$) on its said second trajectory from said chamber into a second region, and to direct each said particle ($M_3$) on its said third trajectory from said chamber into a third region to separate said particles ($M_1$, $M_2$ and $M_3$) according to mass-charge ratio.

14. A multi-mass filter as recited in claim 13 wherein said particles $M_1$, $M_2$ and $M_3$, have a collision frequency, $\nu_{col}$, and respective cyclotron frequencies $\omega_{m1}$, $\omega_{m2}$ and $\omega_{m3}$, and wherein $\omega_{m1}>\omega_{m2}>\omega_{m3}>\nu_{col}$ with said predetermined collisional density being defined when a ratio between $\omega_{m3}$ and said collision frequency with $M_3$ is greater than one ($\omega_{m3}/\nu_{col}>1$).

15. A multi-mass filter as recited in claim 13 wherein said chamber defines an axis, wherein said magnetic field (B) is substantially constant along said axis and is oriented substantially parallel thereto, wherein said electric field (E) is generated with a positive voltage $V_{ctr}$ along said axis and its magnitude is controlled radially therefrom, wherein "e" represents a positive ion charge, and wherein said configuring means comprises:

a first electrical means for creating an electrical field increasing at a first rate radially outward between said axis and a radial distance $a_2$ ($r_2$) to define said first region therebetween and establish a cut-off mass $M_{c2}=er_2^2B^2/(8*(V_{ctr}-V_2))$ with $M_3$ and $M_2$ being greater than $M_{c2}$ to shift said particles $M_3$ and $M_2$ from into said first region into said second region; and a second electrical means for creating an electrical field increasing radially outward between said radial distance $a_2$ ($r_2$) and a radial distance $a_3$ ($r_3$) at a second rate to establish a cut-off mass $M_{c3}=e(r_3^2-r_2^2)B^2/(8*V_2)$ with $M_3$ being greater than $M_{c3}$ to shift particles $M_3$ from said second region into said third region.

16. A multi-mass filter as recited in claim 15 wherein said first electrical means and said second electrical means are concentric electrode rings, and wherein said electrode rings produce a radial electric field in a plane substantially perpendicular to said axis.

17. A multi-mass filter as recited in claim 15 wherein said first electrical means and said second electrical means are combined as a spiral electrode, and wherein said spiral electrode is oriented substantially perpendicular to said axis.

* * * * *

UNITED STATES PATENT AND TRADEMARK OFFICE

CERTIFICATE OF CORRECTION

PATENT NO. : 6,386,374 B1 
DATED : May 14, 2002
INVENTOR(S) : Robert L. Miller, Tihiro Ohkawa and Richard L. Freeman It is certified that error appears in the above-identified patent and that said Letters Patent is hereby corrected as shown below:

Column 1,
Line 4, delete "Application Ser. No." insert -- Application of Ser. No. --
Line 6, delete "which is currently pending"
Line 7, delete "application Ser. No. 09/643,204" insert -- U.S. Pat. No. 6,293,406 --
Line 30, delete "and;" insert -- and --

Column 2,
Line 3, delete "charged. particles." insert -- charged particles. --

Column 3,
Line 13, delete " $\omega_{m1} > \omega_{m2} > \omega_{m3} > V_{ol}$ " insert -- $\omega_{m1} > \omega_{m2} > \omega_{m3} > v_{col}$ --

Line 60, delete " $(8*(V_{ct-}V_2))$ " insert -- $(8*(V_{ctr-}V_2))$ --

Line 67, delete "$B_2$" insert -- $B^2$ --

Column 6,
Line 23, delete " $E_2 = (V_{ctr}-V_2)/r_2$ and $Mc_3 = eB^2/(4*(E_{3/r})) = e(r_3^2-r_2^2)B^2/(8*V_2)$ "

insert -- $E_2 = (V_{ctr}-V_2)/r_2$ and $Mc_3 = eB^2/(4*(E_3/r)) = e(r_3^2-r_2^2)B^2/(8*V_2)$ --

Column 8,
Line 48, delete " $\omega_{m1} > \omega_{m2} > \omega_{m1} > v_{col}$ " insert -- $\omega_{m1} > \omega_{m2} > \omega_{m3} > v_{col}$ --

Signed and Sealed this

First Day of October, 2002

*Attest:*

*Attesting Officer*

JAMES E. ROGAN
*Director of the United States Patent and Trademark Office*